United States Patent [19]

Heiman

[11] 4,221,227

[45] Sep. 9, 1980

[54] SEPARABLE COIN STORAGE TUBE ASSEMBLY

[75] Inventor: Frederic P. Heiman, Philadelphia, Pa.

[73] Assignee: Mars, Incorporated, McLean, Va.

[21] Appl. No.: 932,320

[22] Filed: Aug. 9, 1978

[51] Int. Cl.[3] ..... G07D 3/04

[52] U.S. Cl. ..... 133/3 D

[58] Field of Search ..... 133/1 A, 3 D, 8 R, 8 A, 133/3; 292/204, 207

[56] References Cited

U.S. PATENT DOCUMENTS 1,931,707 10/1933 Quigan ..... 292/204

2,110,434 3/1938 Albin ..... 292/204

FOREIGN PATENT DOCUMENTS 1231427 6/1971 United Kingdom ..... 133/1 A

*Primary Examiner*—Stanley H. Tollberg

*Attorney, Agent, or Firm*—Davis, Hoxie, Faithfull & Hapgood

[57] ABSTRACT

A coin sorting and storage tube assembly for use in vending is separable into halves to facilitate servicing. Cam lock fasteners in the form of a shaft surmounted by a tab portion are rotatably retained in one half. The tab portion passes through a slot in the other half. Turning the fasteners locks the halves together.

9 Claims, 3 Drawing Figures

SEPARABLE COIN STORAGE TUBE ASSEMBLY

Figure 1:
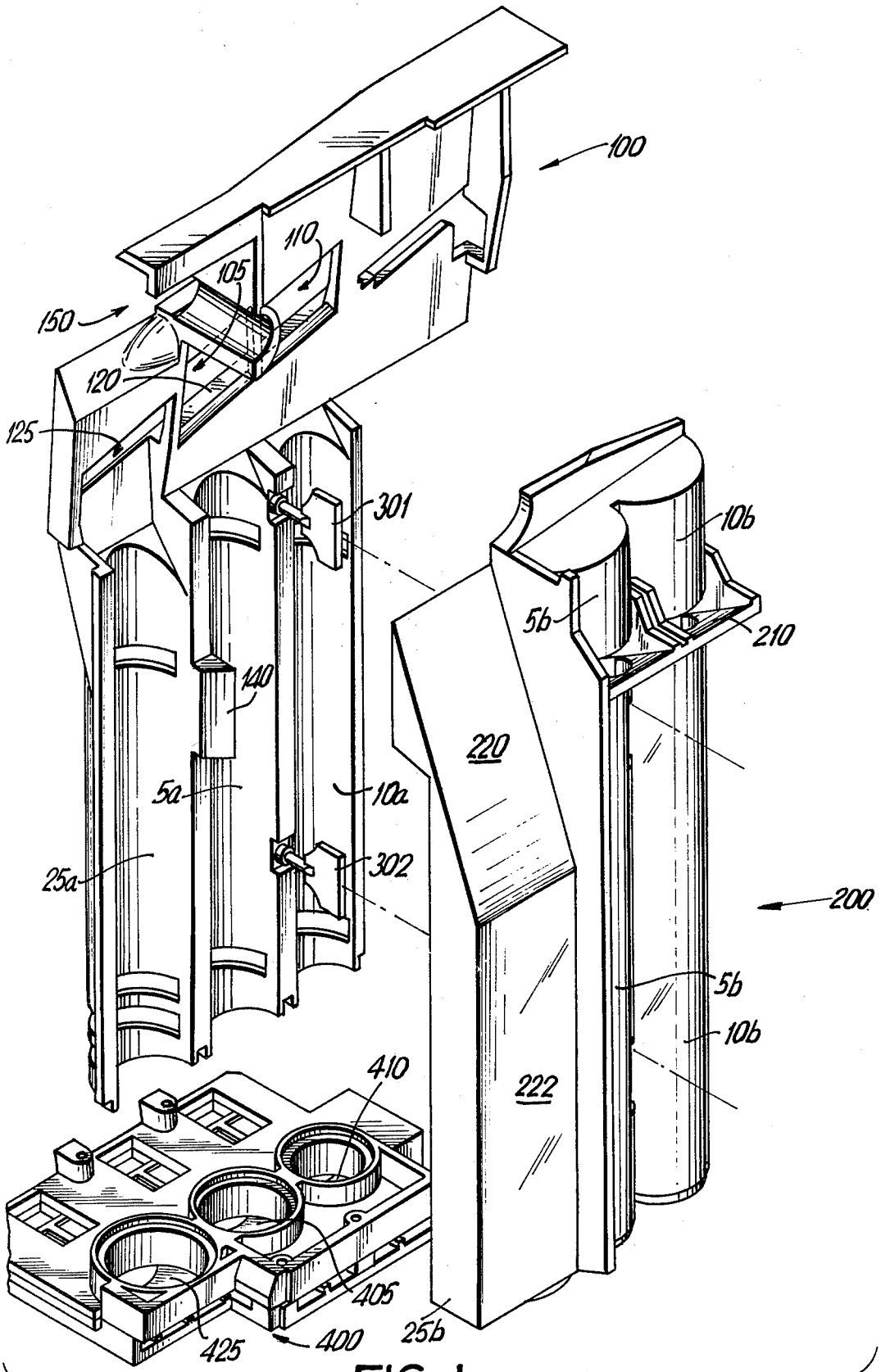

The present invention is concerned with coin and token dispensing apparatus suitable for incorporation in coin operated vending machines and other automatic machines which dispense coins or tokens. For example, such vending machines conventionally incorporate a coin apparatus which receives coins of various denominations, determines the denomination and authenticity of the coins, rejects slugs and coins of unacceptable denominations, determines and sums the values of acceptable coins, produces a vend signal when acceptable coins equaling or exceeding in value the price of the item to be vended have been inserted, and dispenses change in an amount equal to the excess of the value of the inserted coinage over the price of the item selected. The coin selector apparatus is usually housed within a case whose external dimensions and coin box passages for input, rejection and change-giving conform to standards which have evolved in the vending machine industry.

In a coin dispenser for such a vending machine coin apparatus, coin tubes store supplies of coins segregated by denomination for change-giving purposes. The coin tubes are dimensioned to hold sufficient coins for anticipated change-giving purposes, and may be arranged to be replenished by coins of the appropriate denomination from coin sorter apparatus. When coins having a value exceeding the price of the desired item are inserted, the difference from the price is determined and change dispenser mechanisms at the foot of the coin tubes are actuated to dispense the proper change. Apparatus in which the coin tube device of the present invention can be employed is shown, for example, in U.S. Pat. Nos. 3,844,297, 3,814,115, and 3,906,965.

The present invention is principally concerned with the structure of the coin tubes which retain stacks of coins sorted according to denomination for automatic coin dispensing for change-making and the like. According to the present invention the plastic moldings which include the coin tubes are made in separable halves detachably held together by fasteners to permit a machine serviceman to separate the coin tube halves to remove coins, to free coin jams, and to clear the coin tubes of dirt and debris.

Figure 2:
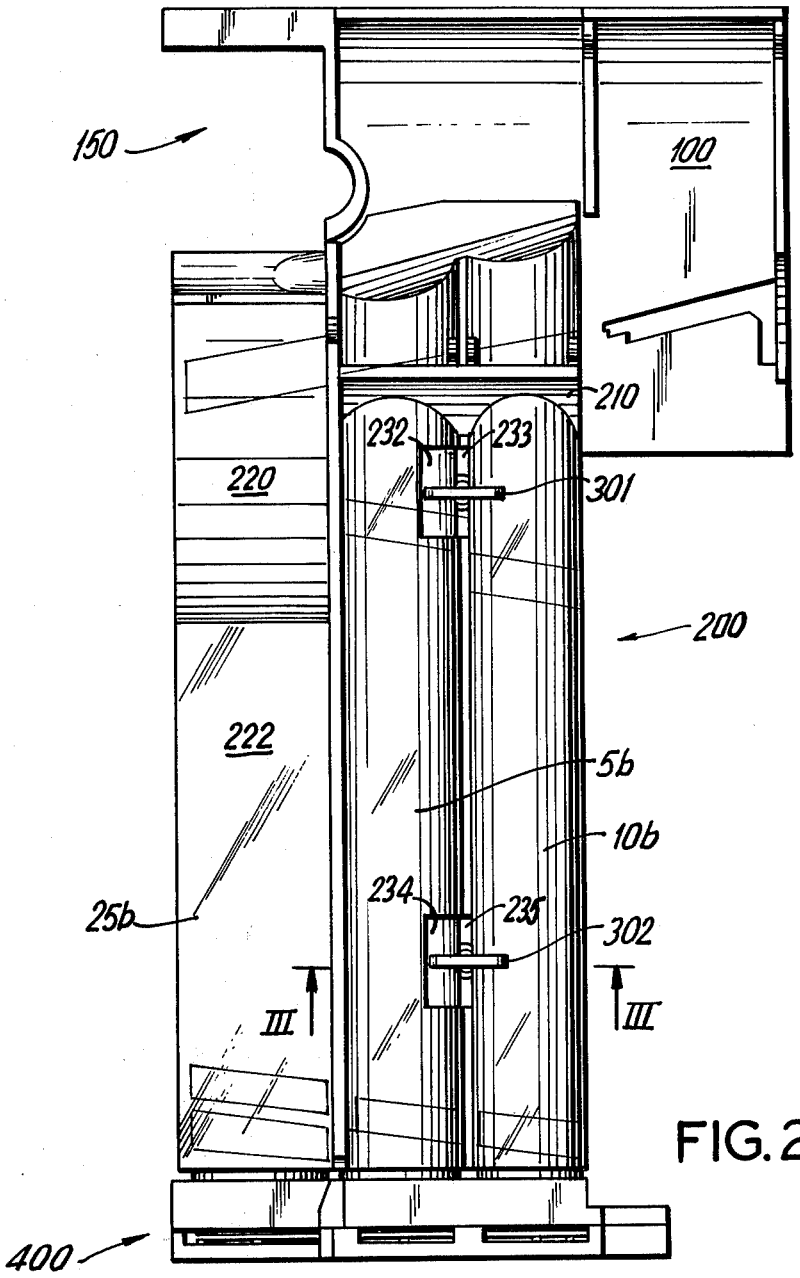
Figure 3:
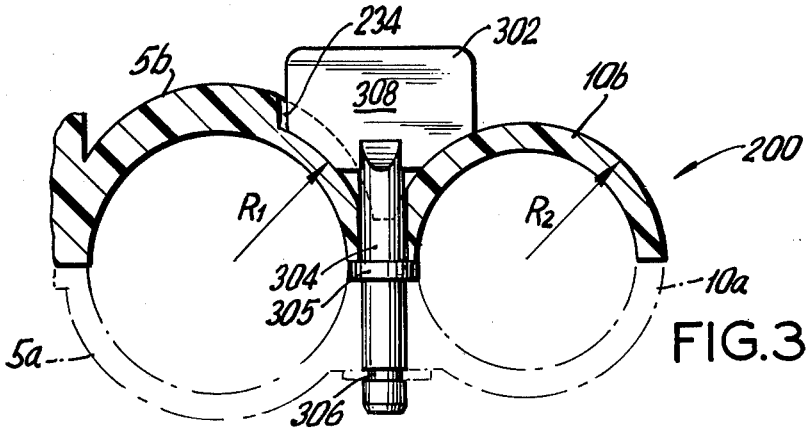

In the drawings:

FIG. 1 is an exploded perspective view of the coin tube device of the present invention, FIG. 2 is an elevational view of the coin tube device, and FIG. 3 is an enlarged, partial view in cross-section taken along line III—III of FIG. 2.

Referring now to the drawings, a preferred embodiment of the coin tube device of the present invention is molded of suitable plastic materials as two major pieces, a rear segment 100, and a removable front segment 200. The rear segment 100 is fastened within the vending machine and the front segment 200 is detachably secured to the rear segment by cam lock latch fasteners 301, 302 to form an assembled device.

The rear segment 100 is molded in one piece of a durable plastic such as a polyphenyl oxide resin. The upper portion of the rear segment includes an inclined coin track 120 which receives acceptable coins from a coin tester above (not shown). The coils roll along coin track 120 until they reach the apertures 110, 105, 125, each of which is sized for the particular coin. When the coin reaches the aperture for that denomination, the coin falls through the aperture and into a coin tube 10, 5, 25 for the denomination of the coin, for example, the ten-cent, five-cent and twenty-five-cent coins of U.S. coinage respectively. The lower portion of the rear segment comprises coin tube halves **10*a*, 5*a*, 25*a*** sized to accomodate coins of different denominations.

The front segment 200 is molded in one piece from a durable, preferably transparent, plastic material such as a polycarbonate resin. The front segment 200 includes the other halves **10*b*, 5*b*, 25*b* of the coin tubes and is configured to mate with the rear segment 100 to form complete coin tubes. A hopper structure 210 permits a machine serviceman to load the coin tubes 5, 10 with coins. The lower ends of the coin tubes attach to a coin dispenser mechanism 400 for dispensing coins to the customer. The surface portion 220, 222 of the outer face of front segment 200 forms a portion of a coin passageway for rejected coins. Coins which are not accepted by the vending machine are routed through aperture 150 of the rear segment 100 from the coin tester above (not shown) and fall along surfaces 220, 222 of the front segment 200** to be returned to the customer.

The front and rear segments 100, 200 fit the coin dispenser mechanism 400 located at the foot of the coin tubes. The coin dispenser mechanism 400 includes horizontally moveable slides 425, 405, 410 which have apertures sized to receive a single coin from the bottom of the coin tube stack. Reciprocation of the moveable slides causes a single coin to be delivered from the coin tube associated with the reciprocated slide in the usual fashion. A more detailed description of a suitable coin dispenser mechanism is found in U.S. Pat. No. 3,814,115.

The front and rear segments 100, 200 are detachably assembled together by cam lock fasteners 301, 302. The fasteners are in the form of a shaft 304 surmounted by a wing tab portion 308. The tab portion 308 freely passes through a slot 233, 235 formed between coin tube halves **5*b* and 10*b* of the front segment 200. Shaft 304 includes an integral collar 305 and circular clip receiving groove 306. The collar and clip serve to retain the cam lock fasteners in the rear segment 100** while allowing them to rotate freely.

Turning the cam lock fasteners 301, 302 through 90° locks the front and rear segments together. Since coin tube halves **10*b* and 5*b* are sized for coins of different denominations, they differ in diameter. The exterior radius of coin tube half 10*b* is designated R2 in FIG. 3. In order that the configuration of tab portion 308 of the cam lock fastener be symmetrical, portions 232,234 of the exterior of larger coin tube half 5*b* are excavated to a radius R1 equal to radius R2. Thus, the surfaces of both coin tube halves 10*b* and 5*b*, which surfaces are engaged by the tab portion 308, are symmetrical to allow the cam lock fasteners to be turned in either direction to lock. Proper alignment of the two segments 100 and 200 is assured by a protuberant tongue 140 located between coin tube halves 25*a* and 5*a* of the rear segment 100. A conforming groove (not shown) is located between coin tube halves 25*b* and 5*b* of segment 200. The tongue 140 and cam lock fasteners 301, 302** together provide three alignment points.

We claim:

1. A device for sorting storing and dispensing coins assorted according to denomination, the device comprising a coin dispenser mechanism, a rear coin tube segment adapted to be affixed within the vending machine, a front coin tube segment detachably assemblable with the rear segment, and fastener means to detachably secure the segments together, the front and rear segments, when assembled, together forming a plurality of generally vertical, cylindrical, coin storage tubes, the front and rear segments being separable in the vicinity of a plane which includes the coin tube axes, the front and rear segments having means to align the segments when assembled, the fastener means comprising a cam lock rotatably carried by the rear segment, the cam lock having a shaft surmounted by a tab portion which passes through a slot formed in the front segment and located between adjacent coin tubes, the tab portion being adapted to cam against the exterior of the adjacent coin tubes when the cam lock is rotated to a position transverse to the slot, one of the front and rear segments including a coin track along which coin roll and coin sorting apertures along the track, each of the apertures being sized to pass a particular denomination coin to allow that coin to enter the appropriate coin tube.

2. The device of claim 1 wherein the exterior surfaces of the coin tubes in the region immediately adjacent the slot in the front segment are in the form of cylinders of equal radii and the tab portion of the cam lock is configured to engage the cylindrical surfaces.

3. The device of claim 2 wherein the fastener means comprise plural cam locks.

4. In a device for sorting and storing coins according to denomination in a coin testing apparatus, the improvement which comprises a plurality of generally vertical coin storage tubes detachably assemblable into a front segment and a rear segment at a plane generally parallel to the longitudinal axes of the tubes and at least one fastener means for detachably securing the two portions together, said fastener means including a shaft located along an axis generally perpendicular to the plane defined by two of the longitudinal axes of the coin storage cylinders.

5. The device of claim 4 wherein the fastener means comprise a cam lock rotatably carried by the rear segment, the cam lock having a shaft surmounted by a tab portion which passes through a slot formed in the front segment and located between adjacent coin tubes, the tab portion being adapted to cam against the exterior of the adjacent coin tubes when the cam lock is rotated to a position transverse to the slot.

6. The device of claim 5 wherein the exterior surfaces of the coin tubes in the region immediately adjacent the slot in the front segment are in the form of cylinders of equal radii and the tab portion of the cam lock is configured to engage the cylindrical surfaces.

7. The device of claim 6 wherein the fastener means comprise plural cam locks.

8. The device of claim 5 wherein the fastener means comprise a cam lock including a shaft and tab which remain attached to the rear segment when the front segment is removed.

9. The device of claim 5 wherein the fastener means comprise a cam lock positioned between adjacent coin storage tubes.

* * * * *